United States Patent [19]

Shimek et al.

[11] 4,408,594

[45] Oct. 11, 1983

[54] FIREPLACE HEATED GRATE

[76] Inventors: Ronald J. Shimek, Rte. 3 Lakeview Dr., Prior Lake, Minn. 55372; Daniel C. Shimek, 2050 Fairmount Ave., St. Paul, Minn. 55105

[21] Appl. No.: 260,351

[22] Filed: May 4, 1981

[51] Int. Cl.[3] ..... F24B 7/00

[52] U.S. Cl. ..... 126/121

[58] Field of Search ..... 126/121, 127, 112, 105 A, 126/163 R, 123, 126; 237/51; 110/162

[56] References Cited

U.S. PATENT DOCUMENTS 4,010,729 3/1977 Egu ..... 126/121

4,305,473 12/1981 Martenson ..... 126/121

*Primary Examiner*—Samuel Scott

*Assistant Examiner*—Randall L. Green

*Attorney, Agent, or Firm*—John B. Sowell

[57] ABSTRACT

A hollow heated grate for a fireplace is provided with an electric motor and a blower inside of the heated fireplace enclosure for circulating cool air from the area to be heated through the hollow grate and returning the heated air to the area to be heated. The electric motor and blower are physically enclosed in a metal plenum box. To avoid overheating the electric motor windings, cool air is circulated over the motor windings when the electric motor is running and cool air is also circulated over the electric motor windings when the electric motor is not running by novel diversionary air vent means including sensing means for opening a movable closure adjacent the diversionary air vent when the electric motor and blower are not circulating cool air.

12 Claims, 7 Drawing Figures

FIREPLACE HEATED GRATE

BACKGROUND OF THE INVENTION

1. Field of the Invention

The present invention relates to heated grates for fireplaces and more particularly to hollow heated grates and means for the forced circulation of air through the heated grates.

2. Description of the Prior Art

Hollow heated grates for fireplaces are generally classified in Class 126, subclass 121 under hot air fireplaces. Most manufacturers of forced air hollow grate hot air fireplaces have found it necessary to place the electric motor and blower outside of the fireplace enclosure to avoid overheating the windings of the electric motor. It is not desirable to heat an ordinary commercial electric motor above 140° F. because an increase in temperature will cause rapid deterioration of the insulation and the organic components in the electric motor. Further, when the electric motor windings are heated above 140° F. the resistance of the electrical windings increase which causes an additional heat build-up in the electric windings which rapidly deteriorates the useful life of the motor.

The applicant has marketed an advanced hot air fireplace grate since 1978 which had an electric motor located inside of the fireplace enclosure. The present invention is directed to an improvement of the plenum and enclosure for the electric motor and blower which may be operated inside the fireplace enclosure without exceeding the recommended temperatures of the windings and bearings of the electric motor and blower.

While the plenum enclosure for prior art electric motors was successful in avoiding the heat-build-up in the motor windings when the electric motor was running there was not adequate protection for the electric motor and bearings of the blower when the user inadvertently turned off the power to the electric motor or there was a power failure while the hot air fireplace was being used.

The above mentioned problem often arises in the spring and fall when the user of a hot air fireplace desires the aesthetic environment of a fire without the necessity for the additional heat of a forced air hollow grate hot air fireplace. To avoid this problem the applicants have employed temperature sensing switches on the plenum which holds the electric motor and blower. The switches are always connected to a source of power to turn on the electricity to the motor and blower when the temperature of the plenum reached a temperature approximately 110° F. This temperature sensing switch solved the problem of the user inadvertently disconnecting the power source of the electric motor which maintained the windings of the electric motor in a cool condition. While this sensing switch would prevent the user from forgetting to turn on the blower to maintain the electric motor cool it can not and did not solve a power failure condition when the hollow grate hot air fireplace is being used. The applicants have suggested that vents could be placed in the plenum which holds the electric motor and blower which would induce the flow of air through the plenum when the electric motor is not running and the plenum is hot. The applicants discovered that there are conditions in which the vents placed in the plenums serve as intakes for ingesting smoke from the fireplace enclosure into the plenum and mixing it with the cool intake air so as to create a condition where smoke is forced back into the area to be heated.

There is an unfulfilled need in the art of hot air fireplaces for providing means for preventing the overheating of the windings of the electric motor and the bearings of the blower without creating a condition which would recirculate smoke into the area which is being heated.

SUMMARY OF THE INVENTION

The primary object of the present invention is to provide a novel plenum for maintaining an electrical motor and blower cool when placed inside of a fireplace area and connected to a hollow hot air grate.

It is another object of the present invention to provide a novel motor and blower plenum for a hot air grate which will circulate cool air over the windings of the electric motor whether or not the electric motor is operable.

It is yet another object of the present invention to provide a novel diversionary air vent in a motor plenum for a hot air grate which will direct cool air over the rotor windings of the electric motor when the motor is inoperable and when the plenum is hot.

It is yet another general object of the present invention to provide a motor plenum which may be placed inside of a fireplace behind a convection barrier door which will circulate the air from the outside area through the plenum and the hollow hot air grate and back into the area to be heated without blowing smoke from the fireplace area into the room.

It is yet another object of the present invention to provide a novel motor plenum which employs a barrier for increasing the cool air circulated by convection over the windings of an electric motor in a hot plenum enclosure.

It is yet another general object of the present invention to provide a novel hot air circulation fireplace grate which is highly efficient and may be used with any type of glass door enclosure.

It is yet another object of the present invention to provide a heating unit having an electric motor and blower assembly which may be connected to a hot air grate which is quieter and concealed from view behind a glass door enclosed fireplace.

In accordance with these and other objects of the present invention there is provided a novel plenum enclosure for an electric motor and blower which is connected to a hollow heated grate of a fireplace for providing hot air circulation therethrough. The novel plenum is ordinarily provided with an intake or cool air from the room to be heated and a outlet connected to the hollow grate for forcing air through the heated grate which returns to the room to be heated. The novel plenum enclosure for the electric motor and blower is further provided with a novel diversionary air vent which includes sensing means for opening and closing the novel diversionary vent to enhance the efficiency of the hollow hot air grate and to avoid smoke from being ingested into the intake of the blower which would be circulated back into the room to be heated.

DESCRIPTION OF THE PREFERRED EMBODIMENT

Figure 1:
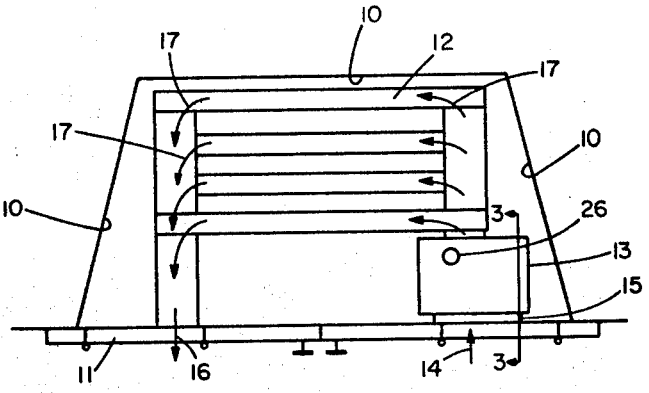
FIG. 1 is a plan view of a forced air hot air grate shown located inside of a fireplace area and having a glass door enclosure.
Figure 2:
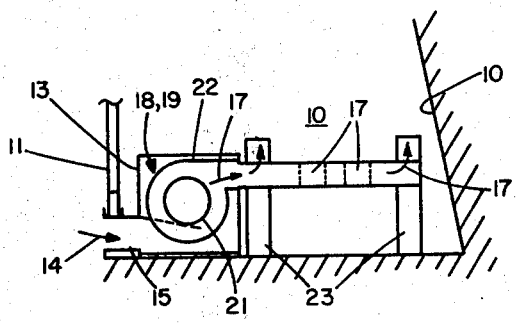
FIG. 2 is a partial side elevation of the forced air hot air grate of FIG. 1.

Refer now to FIGS. 1 and 2 showing the environment in which the novel hollow grate forced air fireplace is preferably employed. The fireplace area 10 may be made from metal or well-known refractory materials to provide a radiating surface. The glass door enclosure 11 may be of the folding type which is split at the middle and folds to either side of the fireplace to provide an open fireplace area or a closed fireplace area as may be desired. The hot air grate generally designated by the numeral 12 is preferably made of two inch square hollow rectangular bars which are welded together to form a cradle or grate in which the front and rear transverse elements are located higher than the center transverse elements. It will be understood that the front and rear transverse elements of the grate are connected at their intersecting surfaces and have a hollow space therebetween. The center transverse elements connect directly with the sides of the grate and have hollow spaces therebetween. Accordingly, when the electric motor and blower inside of the plenum 13 induces air into intake as shown by arrow 14 through the inlet connection 15 the air is circulated through the hollow hot air grate and discharged as outlet air as shown by the arrows 16 and generally follows the path shown by the arrow for circulating air 17. The circulating air 17 is best shown in FIG. 2 entering the intake connection 15 at arrow 14 and is drawn into the end inlet 21 of the electric motor 18 and blower 19 and discharged through the outlet connection 22 which connects to the grate 12. The leg 23 of the grate 12 may be made of the same hollow rectangular material as the grate but does not have an opening into the grate at its point of connection.

The prior art structure shown in FIGS. 1 and 2 have been some commercially and have operated successfully as long as the electric motor 18 and blower 19 continue to run when the plenum 13 and the grate 12 are heated well above 140° F. However, when the power to the electric motor 18 is inadvertently shut off or a power failure occurs the cool intake air 14 no longer circulates through the plenum 13 and the temperature of the motor and motor windings can rise well above 140° F. and may even approach the temperature of the grate 12 and plenum 13 which can easily be heated to over 500° F.

Figure 3:
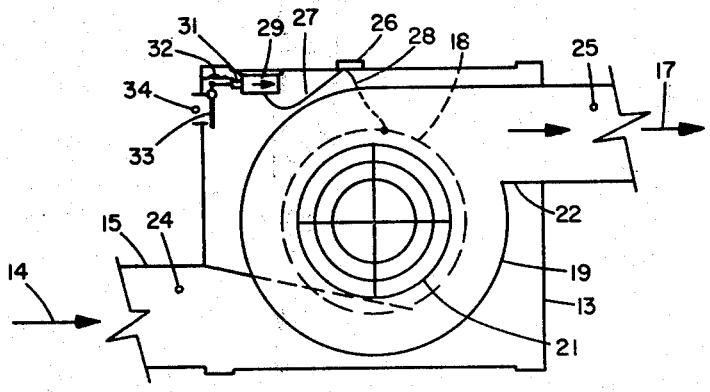
FIG. 3 is an enlarged elevation detail in section of the improved plenum motor enclosure of the type shown in FIGS. 1 and 2 taken at lines 3—3 of FIG. 1 showing the novel closure means therein.

Refer now to FIG. 3 showing a preferred embodiment of the present invention wherein plenum 13 is provided with an inlet connection 15 connected to an inlet port 24 of the plenum 13 for conducting the intake air 14 through the intake 21 of the blower 19 and for discharging the intake air 14 as circulating air 17 through the outlet port 25 of plenum 13. In the preferred embodiment of FIG. 3 a temperature sensitive switch 26 is connected to a source of electricity not shown and is provided with power leads 27 and 28 which are connected to the electric solenoid 29 and the electric motor 18 respectively. When power is applied to the solenoid 29 the solenoid pulls the plunger 31 against the normal force of spring 32 causing the closure means 33 to maintain the diversionary vent 34 in a closed position. However, should the power on line 27 be disconnected or inactivated for any means the spring 32 will pull the solenoid plunger 31 to the left causing the closure means 33 to pivot on pivot hinge 35, thus, opening the closure means 33.

When the grate 12 and connected plenum 13 are not ordinarily in use the temperature sensitive switch 26 is at a temperature low enough to avoid any power being applied to the solenoid 29 and the electric motor 18. When the temperature inside of the plenum 13 or at the temperature sensitive switch 26 rises to approximately 110° F. power is applied to the solenoid 29 and the electric motor 18. The reason for this temperature sensitive switch is to avoid circulating cold air in the room before the hollow grate is heated.

Figure 4:
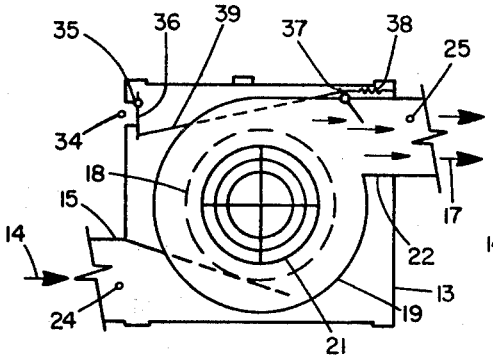
FIG. 4 is an enlarged detail of a plenum motor enclosure of the type shown in FIG. 3 and showing a modified closure means.

Refer now to FIG. 4 showing a modified embodiment of the novel plenum of FIG. 3. Plenum 13 is provided with an inlet connection 15 for intake air 14. The closure means 36 is pivoted on pivot hinge 35 to open the diversionary vent 34 by mechanical means which includes a pivoted damper 37 that is ordinarily biased open by return spring 38 which acts on one end of lever 37 and link 39 to maintain the closure means 36 in the open position unless the motor 18 is circulating intake air so as to bias pivoted lever 37 in a direction to close closure means 36 through pivoted link 39. It will be understood that the operational mode of FIG. 3 is substantially the same as that in FIG. 4. When the electric motor 18 and blower 19 are running the closure means 36 maintains the diversionary vent 34 closed. During all other operations the diversionary vent 34 is open and if for any reason the motor stops running the closure means 36 opens to protect the windings of the motor and the bearings of the blower.

Figure 5:
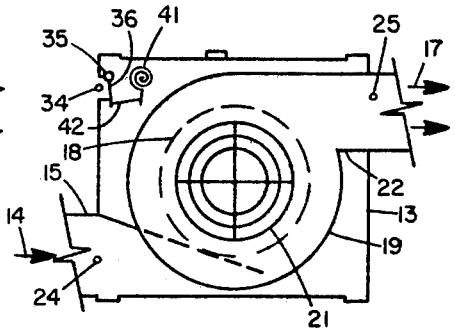
FIG. 5 is another enlarged detail of the plenum motor enclosure of the type shown in FIGS. 3 and 4 showing yet another form of closure means.

Refer now to FIG. 5 which shows a simplified and modified form of the invention. In-take air at arrow 14 is circulated in a manner identical to that explained with regard to FIGS. 3 and 4. The only modification in FIG. 5 is the manner in which the closure means 36 is being operated. In this modified form a coiled bi-metallic spring 41 is pivotally connected to a pivot link 42 which connects to the closure means 36. When the temperature inside of plenum 13 rises above 110 F. the bi-metallic spring starts opening the closure means 36 so as to permit intake air 14 to flow through intake 15 around the motor windings and out the diversionary vent 34 thus maintaining the motor windings at a safe and recommended temperature. It will be understood that if the motor 18 is properly running and the intake air 14 is at room temperature the bi-metallic spring 41 will bearly maintain the closure means 36 closed. Preferably bi-metallic spring 41 is mounted on an adjustable mounting block against the side of plenum 13 so that the bi-metallic spring may be adjusted for closing closure means 36 under environmental conditions which are not ordinarily incurred.

Figure 6:
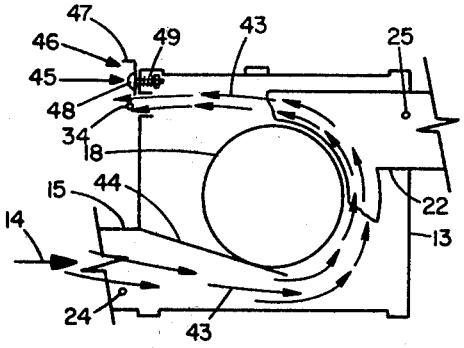
FIG. 6 is an enlarged detail of a plenum motor enclosure of the type shown in FIGS. 3 to 5 and showing yet another modified closure means and having a baffle for enhancing the flow of cool air over the electric motor due to convection air flow.

Refer now to FIG. 6 showing yet another embodiment of the diversionary vent and closure means and an enhancement to the flow of convection cooling air. In-take air at arrow 14 is conducted through inlet connection 15 and into plenum 13 when the plenum 13 is hot and the motor 18 is not running. The path of the convection air as shown by the arrows 43 is conducted under the baffle 44 and passes around the outside of the electric motor 18 and is again conducted to the diversionary vent 34 where it is free to pass outside the plenum 13 into the fireplace area. It will be understood that when the plenum 13 is hot it causes a convection current which draws in intake air at intake 15 and discharges the air 43 after it passes over the electric motor at the higher elevation diversionary vent 34. While the arrows shown for the convection cool air 43 are not exact it will be understood that the air must circulate within the plenum 13 and around the electric motor 18 before it can pass through the diversionary vent 34 because the baffle 44 describes a preferred direction for the convection air 43. Even though some air could force its way through the blades of the blower 19 it is not a preferred direction and the majority of the convection air 43 serves its purpose to cool the electric motor 18. Under actual operating conditions the higher the heat of the grate 12 and plenum 13 the higher the flow of convection cooling air 43. Under actual operating conditions with a plenum box 13 heated to a temperature approximately 300° F. the intake air 14 at room temperature was capable of cooling the electric motor 18 to approximately 100° F. It will be understood that the size of the inlet connection 15 is approximately four to six times larger than the area of the diversionary vent 34 so as to maintain this convection action.

The closure means 45 consists of an L-shaped plate 46 having an operating level 47 so as to permit the plate 46 to be slidably and vertically moved to cover the diversionary vent 34. Plate 46 is maintained in face-to-face contact with the side wall of plenum 13 by a screw 48 which has a spring 49 urging it into contact with plate 46.

Figure 7:
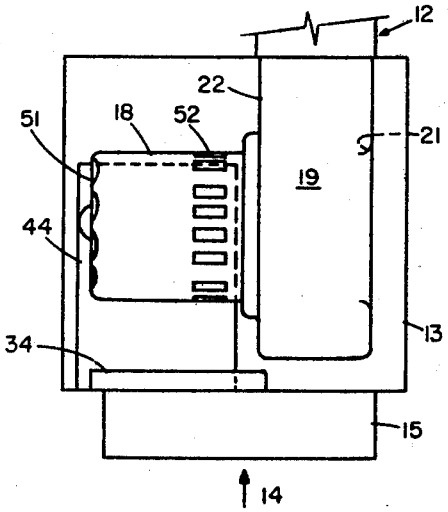
FIG. 7 is a plan view of the novel motor closure shown in FIG. 6 to better illustrate the convection air flow under the baffle and over the electric motor.

Refer now to FIG. 7 which is a top view of the plenum 13 showing a preferred arrangement of the baffle 44 in FIG. 6. As explained herein before the intake 15 is larger in area than the diversionary vent 34 by a ratio of four to six times. Thus, the intake air 14 which is employed to cool the electric motor 18 when the electric motor is not running is diverted under the baffle 44 so as to direct its path around the motor 18 rather than into the intake 21 of the blower 19. In the preferred embodiment and modified examples of the electric motor 18 and blower 19 the electric motor 18 is provided with a blower inside of the motor housing so as to pull air into one end of the motor shown at openings 51 and direct the motor over the windings and discharge it through another opening such as opening 52. The internally fan cool motor 18 will maintain a lower operational temperature in the environment of plenum 13 than a sealed motor.

In the preferred embodiment of the present invention a blower 19 capable of circulating one hundred cubic feet of air per minute through the grate 12 is capable of producing 40,000 BTU's per hour with an average wood fire in the grate. Not only does the novel plenum increase the efficiency of the transfer of heat to the area to be heated but the motor is fully protected within its recommended operational temperature. By placing the plenum 13 inside of the glass door enclosure 11 the sound of the motor is greatly diminished and the hazard of having a motor located outside of the enclosure is eliminated.

The embodiments shown in FIGS. 3 to 7 all have a diversionary vent 34 which may be maintained at an open position when the electric motor 18 is not running. It has been discovered that a condition exists which will permit smoke to be ingested through the diversionary vent 34 which has been eliminated by the present invention whether operated manually or automatically by the closure means shown and described hereinbefore. When the present invention is placed behind a glass door enclosure in which there are vent adjusting means which will shut off substantially all or all of the in-take air 14 then the diversionary vent 34 could become an auxilliary inlet for smoke into the plenum 13. By providing the novel closure means explained hereinbefore it is impossible for the electric motor 18, when running, to pull smokey air through the diversionary vent 34 because it is sealed off by the closure means.

We claim:

1. A plenum for cooling an electric motor in a fireplace enclosure environment, comprising:

a box shaped plenum adapted to be placed in a heated fireplace, an electric motor mounted in said plenum, a blower connected to said electric motor in said plenum, an inlet to said blower inside said plenum, an outlet port in said plenum, an outlet from said blower connected to said outlet port in said plenum, a cool air inlet port in said plenum, a diversionary air vent in said plenum located at an elevation above said cool air inlet port, said diversionary vent comprising a normally open movable closure, said movable closure adapted to be opened when said electric motor and said blower are not circulating cool air through said plenum, and means for closing said movable closure when said electric motor and said blower are circulating cool air through said plenum, whereby cool air is circulated from said cool air inlet port through said diversionary air vent when said plenum is hot, thus creating convection cooling of said electric motor when said electric motor is not running.

2. A motor plenum as set forth in claim 1 wherein said means for closing said movable closure comprises an electric solenoid means.

3. A motor plenum as set forth in claim 1 wherein said means for closing said movable closure comprises spring closure means.

4. A motor plenum as set forth in claim 3 wherein said spring closure means further comprises a damper lever located in the outlet from said blower to said outlet port.

5. A motor plenum as set forth in claim 1 wherein said means for closing said movable closure further includes bi-metallic spring means biased to open said movable closure when the air in said plenum is hot.

6. A motor plenum as set forth in claim 1 wherein said means for closing said movable closure comprises a mechanical thermostat coupled to open said movable closure when the temperature in the said plenum rises above 140° degrees fahrenheit.

7. A motor plenum as set forth in claim 1 wherein said means for closing said movable closure comprises a temperature sensitive element which opens said movable closure indicating that the electric motor is not properly circulating air from said cool air inlet port in said plenum to cool said electric motor.

8. A motor plenum as set forth in claim 1 which further includes a baffle inside said plenum adjacent said cool air inlet port for directing the cool air from said inlet port over the windings of the electric motor before being directed to said diversionary air vent during convection cooling.

9. A motor plenum as set forth in claim 2 which further includes temperature sensitive switch means for energizing said electric motor and said electric solenoid means.

10. A motor plenum as set forth in claim 1 wherein said means for closing said movable closure comprises a baffle plate slidably mounted on the side of said plenum and adapted to be moved to cover said diversionary air vent when said electric motor is normally not energized to circulate cool air through said plenum.

11. A motor plenum as set forth in claim 10 wherein said slidable baffle plate is spring biased in engagement with the side of said plenum and provided with a lever for sliding said plate up and down.

12. A method of maintaining an electric motor in a fireplace plenum enclosure at a relatively low operational temperature, comprising:

enclosing said electric motor in a metal plenum box, providing a lower intake port in the side of said metal plenum, providing an upper diversionary vent port on the same side of said metal plenum, providing an outlet port on the side of said metal plenum, providing an electric blower connected to said electric motor and having a blower inlet inside of said metal plenum and a blower outlet connected to said outlet port, means for opening said diversionary vent when said electric motor is not running, and closing said diversionary vent when said electric motor is running, and normally exhausting cool intake air from said lower intake port out through said diversionary vent when said electric motor is not running by convection heating the cool intake air with the heat of said metal plenum thereby providing convection cooling for said electric motor.

* * * * *